US005138590A

United States Patent [19]

Masuda et al.

[11] Patent Number: 5,138,590

[45] Date of Patent: Aug. 11, 1992

[54] ELECTRONIC APPARATUS HAVING MOVABLE CASE

[75] Inventors: Yuichi Masuda, Kokubunji; Katsuaki Karasawa, Higashimurayama, both of Japan

[73] Assignee: Casio Computer Co., Ltd., Tokyo, Japan

[21] Appl. No.: 788,214

[22] Filed: Nov. 5, 1991

[30] Foreign Application Priority Data

Nov. 8, 1990 [JP] Japan ..... 2-301179
Dec. 31, 1990 [JP] Japan ..... 2-406221[U]

[51] Int. Cl.[5] ..... G04B 47/00; G04B 25/00

[52] U.S. Cl. ..... 368/10; 368/88; 368/204; 368/276

[58] Field of Search ..... 368/10, 88, 204, 276–278; 364/705, 710.1

[56] References Cited

U.S. PATENT DOCUMENTS 4,436,435 3/1984 Ushikoshi ..... 368/71
4,444,513 4/1984 Proellochs et al. ..... 368/223
5,050,138 9/1991 Yamada et al. ..... 368/10

*Primary Examiner*—Vit W. Miska

*Attorney, Agent, or Firm*—Frishauf, Holtz, Goodman & Woodward

[57] ABSTRACT

In an electronic apparatus with a first case and a second case movable to opening/closing positions of the first case, there is provided electro-optical converting means at a portion of the first case which is located opposite to the second case when the second case is opened at a predetermined opening angle. The electro-optical converting means converts an electric signal obtained from a first electronic circuit employed in the first case into an optical signal. Then, an optical-electro converting means is employed at a portion of the second case which is located opposite to the electro-optical converting means when the second case is opened at a predetermined opening angle. The optical-electro converting means converts the optical signal produced from the electro-optical converting means into an electric signal. When the second case is opened at a predetermined opening angle, the signal transmission between a first electronic circuit employed in the first case and a second electronic circuit employed in the second case is carried out via the electro-optical converting means and optical-electro converting means.

28 Claims, 11 Drawing Sheets

ELECTRONIC APPARATUS HAVING MOVABLE CASE

BACKGROUND OF THE INVENTION

The present invention relates to an electronic apparatus having a first case and a second case capable of being opened/closed with respect to the first case.

Conventionally, there are various electronic apparatuses such as laptop type personal computers and electronic notebooks, which each is arranged by an upper case and a lower case. The upper case is movably connected to the lower case at an opening position and a closing position. In such conventional electronic apparatuses, electronic circuits employed in the upper and lower cases are electrically connected with each other via flexible leads in order that either signals are transmitted between these electronic circuits employed in both of the upper and lower cases, or power of a battery stored in one case is supplied to the electronic circuit employed in the other case.

However, the above-described conventional electronic apparatuses have the following problems. That is, since the flexible leads are deformed in connection with opening/closing operations of both the upper/lower cases, durability of the flexible leads is deteriorated. Furthermore, as the flexible leads are exposed outside the cases, there are risks that these flexible leads are caught by some articles and thus the flexible leads may be damaged.

SUMMARY OF THE INVENTION

It is therefore an object of the present invention to provide an electronic apparatus having first and second cases movable to opening/closing positions, and capable of either transmitting signals between electronic circuits employed in the first and second cases, or supplying power of a cell employed in one case to the electronic circuit employed in the other case without employing such flexible leads. Accordingly, the inventive electronic apparatus owns higher durability and reliability than those of a conventional electronic apparatus.

To achieve the above-described object, an electronic apparatus having cases movable to opening/closing positions, according to the present invention, is arranged by:

a first case having a first electronic circuit therein;

a second case having a second electronic circuit, which is movably mounted on the first case so as to be movable relative to the first case between opening and closing positions;

electro-optical converting means mounted to a first portion of the first case positioned opposite to the second case when the second case is opened to a predetermined opening angle, for converting a first electric signal obtained from the first electronic circuit within the first case into an optical signal; and, optical-electronic converting means mounted to a second portion of the second case positioned opposite to the electro-optical converting means when the second case is opened at said predetermined opening angle, for receiving the optical signal produced by the electro-optical converting means to be converted into a second electric signal and for supplying the electric signal to the second electronic circuit employed within the second case.

With the above-described arrangement of the electronic apparatus according to the present invention, either the signal transmission between the first and second electronic circuits employed in the first and second cases, or the supply of power from the battery employed in one case to the electronic circuit employed in the other case can be performed without employment of any leads. Therefore, durability and reliability of the electronic apparatus can be improved.

DESCRIPTION OF THE PREFERRED EMBODIMENTS

(1) First Preferred Embodiment

Referring now to FIGS. 1 to 4, an electronic wristwatch, according to a first preferred embodiment of the present invention, will be described in detail.

(a) Construction

Figure 1:
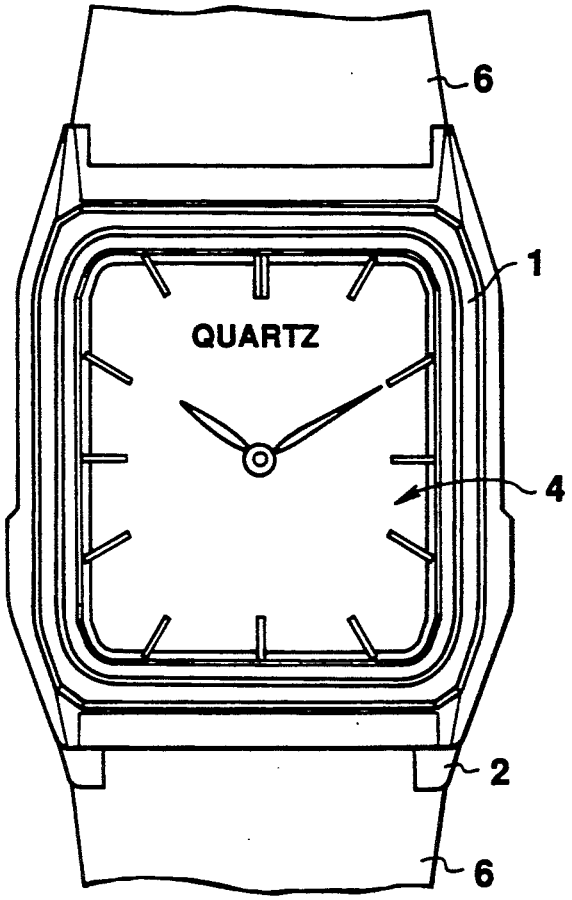
FIG. 1 is a plan view of an electronic wristwatch, according to a first preferred embodiment of the present invention, an upper case of which is closed.
Figure 2:
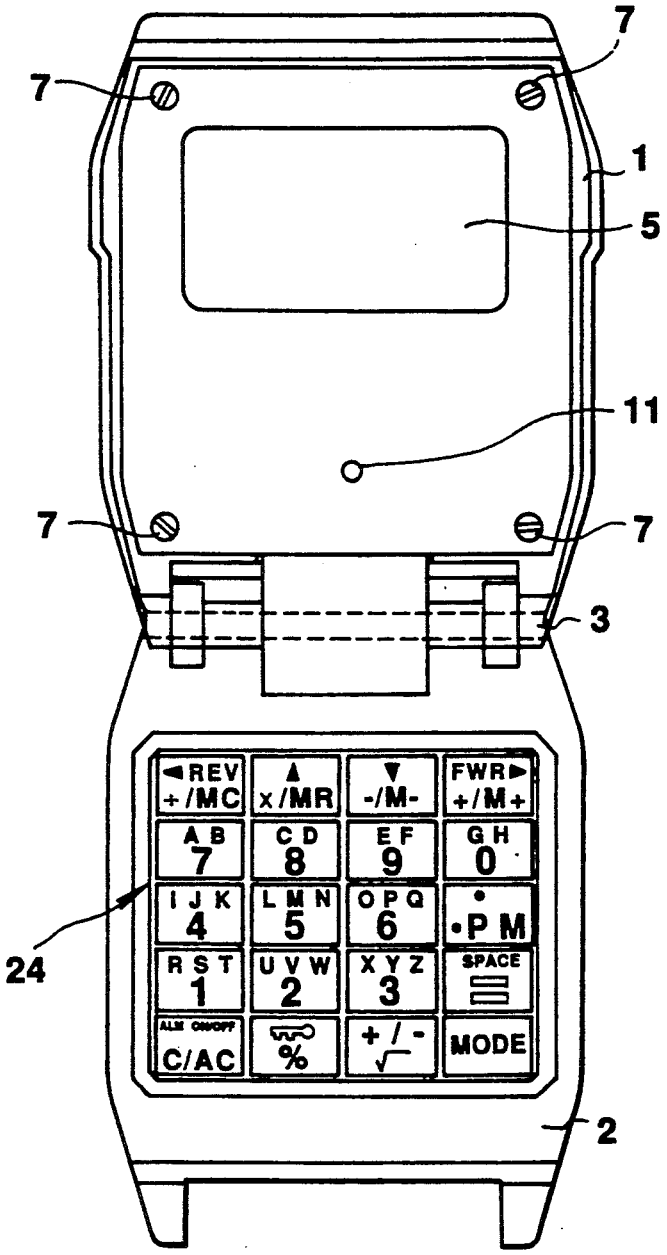
FIG. 2 is a plan view of the electronic wristwatch shown in FIG. 1, the upper case of which is opened.
Figure 3:
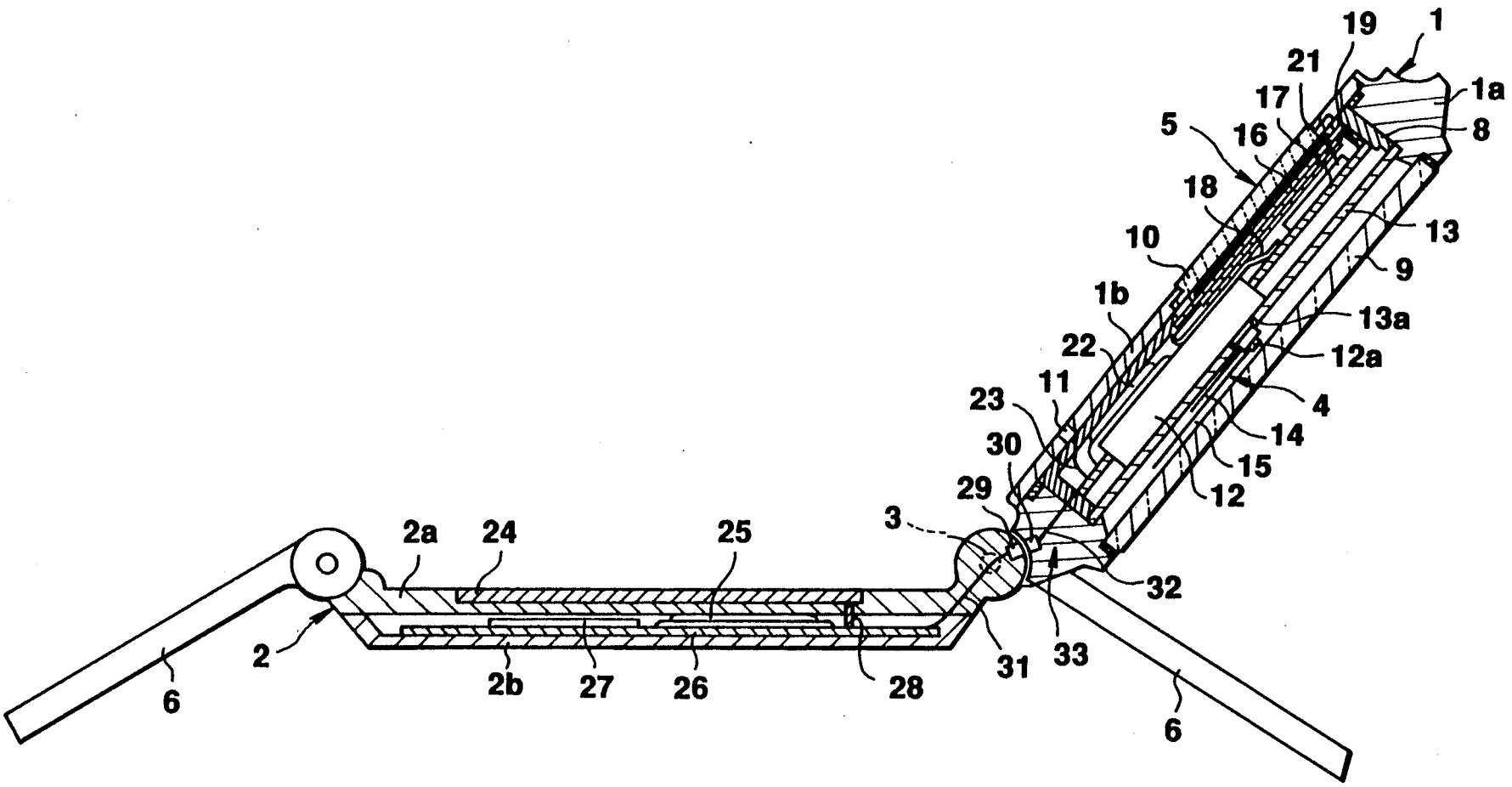
FIG. 3 is a sectional view of the electronic wristwatch shown in FIG. 1, the upper case of which is opened.

FIGS. 1 and 2 represent an outer appearance of the electronic wristwatch according to the first preferred embodiment. FIG. 1 represents the first electronic wristwatch in which an upper case 1 is closed on a lower case 2. FIG. 2 represents the first electronic wristwatch, the upper case 1 of which is opened. The upper case 1 is movably mounted on the lower case 2 via a pin 3 to opening/closing positions. A hand display unit 4 capable of displaying present time by an hour hand and a minute hand is provided on an upper part of the upper case 1, and a liquid crystal display unit 5 is provided on a lower part thereof. Wrist bands 6 and 6 are provided with a front edge and a rear edge.

The upper case 1 is constructed of a case body 1*a* and a lid 1*b*. The lid 1*b* is mounted on the case body 1*a* by screws 7. A housing 8 equipped with the hand display unit 4 and the liquid crystal display unit 5 is stored within the upper case 1. A timepiece glass 9 used to view the hand display unit 4 is attached to an upper surface of the case body 1*a*, and also another glass 10 used to observe the liquid crystal display unit 5 is also attached to the lid 1*b*. An optical sensor 11 for detecting the opening/closing operations of the upper case 1 is arranged on the connection side of the lid 1*b*.

The hand display unit 4 indicates present time by driving the hour hand and minute hand. A hand shaft 12*a* of an analog movement provided within the housing 8 is projected via a center hole 13*a* of a dial plate 13 provided at an upper portion of the housing 8 toward an upper direction, and the hour hand 14 and the minute hand 15 are mounted to a tip portion of the projected hand shaft 12.

The liquid crystal display unit 5 is constructed of a liquid crystal display panel 16 and a circuit board 17 and the like provided within the housing 8. The liquid crystal display panel 16 is electrically connected via a film substrate 18 and an inter connector 19 to the circuit board 17. On the circuit board 17, electronic parts or components such a crystal oscillating element and an LSI (large-scale integration) are provided. The electronic components for instance LSI 21 are driven by a battery 22 stored inside the upper case 1. The optical sensor 11 is also connected via a lead wire 23 to the circuit board 17.

The lower case 2 is constructed of an upper plate 2*a* and a bottom plate 2*b*. A sheet key 24 having a large quantity of switches is arranged on an upper surface of the upper plate 2*a*. A battery 25 and a circuit board 26 and the like are stored within the lower case 2. An LSI 27 is mounted on the circuit board 26 and is electrically connected to the sheet key 24 via the lead 28.

Then, a light emitting diode 29 and a photosensor 30 are provided in such a manner that the light emitting diode 29 is positioned opposited the photosensor 30 while the upper case 1 is opened at a preselected angle. Lead wires 31 and 32 are electrically connected via the corresponding light emitting diode 29 and photosensor 30 to the circuit board 26 and circuit board 17. Both the light emitting diode 29 and photosensor 30 constitute a photocoupler unit 33 under the above-described opposite state (As will be discussed later, these light emitting diode 29 and photosensor 30 are practically constructed of 9 light emitting diodes 29*a* to 29*i* and 9 photosensors 30*a* to 30*i* which are positioned opposite to each other). As a consequence, the electric signals derived from LSI 27 are supplied via the circuit board 26 and lead wire 31 to the light emitting diode 29, whereby the electric signals are converted into optical signals that are supplied to the photosensor 30. The optical signals are converted into corresponding electric signals by the photosensor 30. Then, the electric signals are supplied via the lead wire 32 to LSI 21 employed in the circuit board 17 so that drive signals are produced and supplied to a liquid crystal panel 16.

Circuit Arrangement of First Electronic Wristwatch

Figure 4:
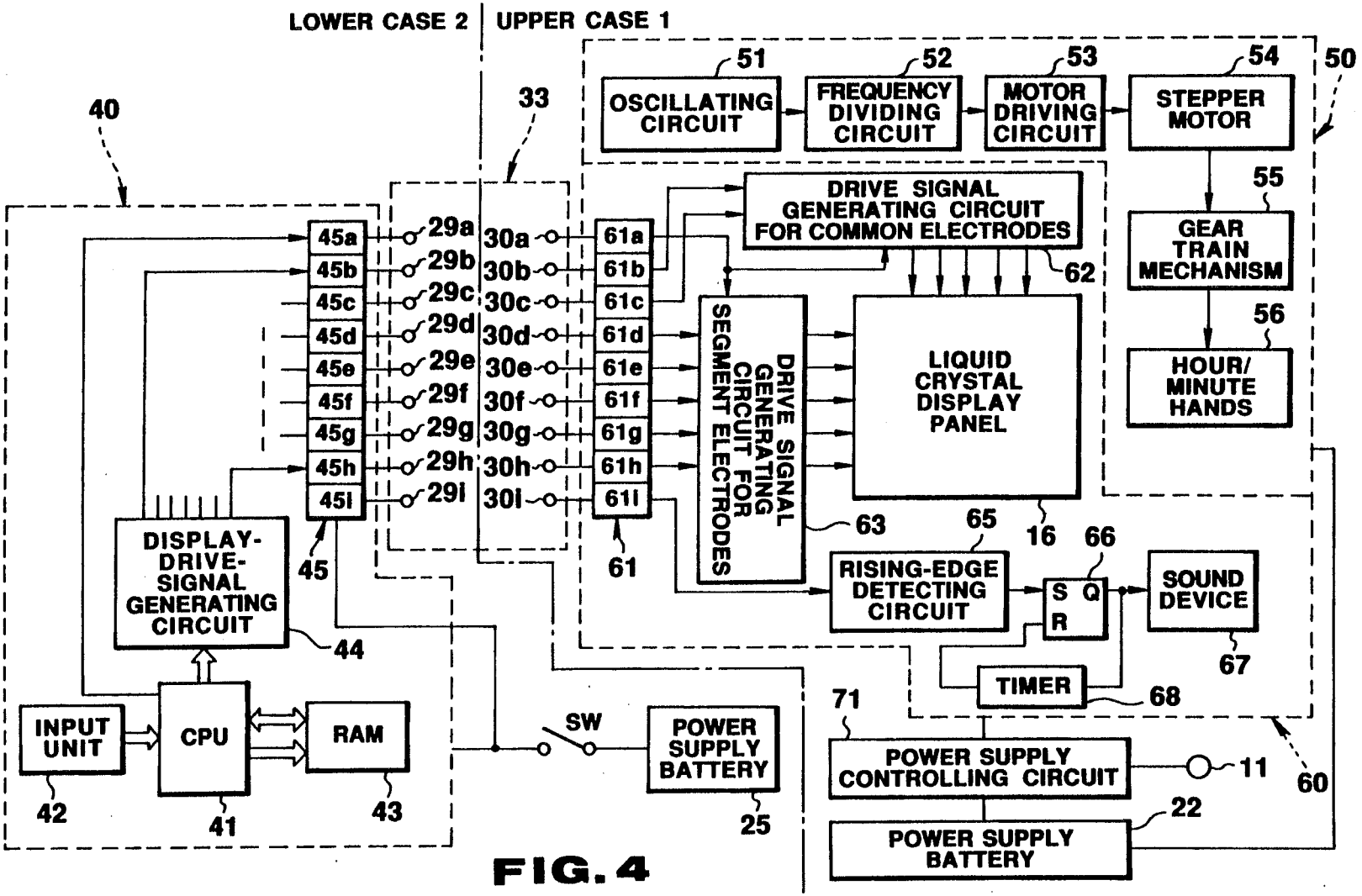
FIG. 4 is a schematic block diagram for representing a circuit arrangement of the electronic wristwatch shown in FIG. 1.

FIG. 4 represents a circuit arrangement of the electronic wristwatch according to a first preferred embodiment of the present invention. This circuit arrangement is constructed of a lower case circuit unit 40 for the lower case 2 side; a power supply switch "SW"; a power supply battery 25; an upper case first circuit unit 50 employed in the upper case 1 side; a second circuit unit 60 for the upper case 1; a power supply control circuit 71; an optical sensor 11; a power supply battery 22; and a photocoupler unit 33 for transmitting the signals from the first circuit unit 40 of the lower case to the second circuit unit 60 of the upper case.

The first circuit unit 40 of the lower case 2 is such a circuit unit that this circuit is operable upon receipt of power from the power supply battery 25 under condition that the power supply switch "SW" is turned ON. The first circuit 40 is mainly arranged by CPU 41 and other relevant circuits. The function of CPU 41 is to process the data from other circuit arrangements and supply the processed data. Also, the control signals are sent to other circuit arrangements in order to control these circuit arrangements. An input unit 42 is equipped with a large quantity of sheet switches of the above-described keysheet 24, and sends an input signal corresponding to any of these sheets switches which is operated to CPU 41. Under control of CPU 41, RAM (Random Access Memory) 43 stores therein the data supplied from CPU 41 and sends the data stored therein to CPU 41. A display-drive-signal generating circuit 44 is to generate the display drive signal related to a liquid crystal display apparatus 64 (will be discussed later) under control of CPU 41. An amplifier circuit 45 is constructed of 9 amplifiers 45*a* to 45*i* which each amplifies the signals derived from CPU 41 and display-drive-signal generating circuit 44.

The photocoupler unit 33 is constructed of 9 pieces of photocouplers arranged by the light emitting diodes 29*a*, 29*b*, . . . , 29*i* and the corresponding photosensors 30*a*, 30*b*, . . . , 30*i*. The photocoupler arranged by the light emitting diode 29*a* and photosensor 30*a* is to transmit the timing signal from CPU 41 to the second circuit unit 60 of the upper case 1 side. The photocouplers arranged by the light emitting diodes 29*b* to 29*h*, and the photosensors 30*b* to 30*h* are to transmit the display drive signals from the display-drive-signal generating circuit 44 to the second circuit unit 60 of the upper case 1 side. The remaining photocoupler arranged by the light emitting diode 29*i* and photosensor 30*i* is employed to detect that the upper case 1 is opened at a preselected angle with respect to the lower case 2, and then the corresponding light emitting diode 29*i* is positioned opposite to the photocoupler 30*i*.

The first circuit unit 50 of the upper case 1 is such a circuit unit operable by continuously receiving the power supplied from the power supply battery 22, that is, an oscillating circuit 51 continuously oscillates a signal having a predetermined frequency, a frequency dividing circuit 52 frequency-divides the oscillating signal to obtain a 1-minute period signal. The 1-minute period signal is supplied to a motor driving circuit 53. A motor driving circuit 53 drives a stepper motor 54 in response to the 1-minute period signal. The stepper motor 54 moves hour/minute hands 56 via the gear train mechanism 55.

A power supply controlling circuit 71 supplies power from the power supply battery 22 to the second circuit 60 employed in the upper case when the output of the optical sensor 11 is an H (high) level, namely the upper case 1 is being opened.

The second circuit unit 60 of the upper case 1 is such a circuit unit that the power is received via the power supply controlling circuit 71 and various data are displayed on the liquid crystal display panel 16 upon receipt of the various signals via the photocoupler unit 33. The amplifier circuit 61 is constructed of 9 pieces of amplifiers 61*a* to 61*i* which each amplifies the output from the respective photosensors 30*a* to 30*i* of the photocoupler unit 33. A drive signal generating circuit 62 for common electrodes is such a circuit operable in synchronism with the timing signal which is sent from CPU 41, amplified by the amplifier 45, and then amplified by the amplifier 61*a* via the photocoupler constructed of the light emitting diode 29*a* and the photosensor 30*a*, that a common electrode driving signal is supplied to the liquid crystal display panel 16 by receiving the display drive signals which are sent from the display-drive-signal generating circuit 44, amplified by the amplifiers 45*b* and 45*c* respectively, and then amplified by the amplifiers 61*b* and 61*c* via the photocoupler. A drive signal generating circuit 63 for segment electrodes is such a circuit that is operable in synchronism with the same timing signal as the timing signal supplied to the drive signal generating circuit 62 for common electrodes, and a segment electrode drive signal is supplied to the liquid crystal panel 16 by receiving the display drive signal which has been amplified by the respective amplifiers 45*d* to 45*h* and also amplified by the amplifiers 61*d* to 61*h* via the corresponding photocouplers. A rising-edge detecting circuit 65 is such a circuit to detect a rising edge of a signal which is outputted from the amplifier 45*i* after the power supply switch "SW" is turned ON, and inputted thereto via the photocoupler arranged by the light emitting diode 29*i* and photosensor 30*i*, and the amplifier 61*i*, and also to derive a one-shot pulse signal when the rising edge is detected. An RS flip-flop 66 is brought into a set condition by receiving the one-shot pulse signal of the rising-edge detecting circuit 65, and delivers an output "Q" to a sound device and a timer 68. The sound device 67 produces a preselected sound while the output "Q" of the RS flip-flop 66 is being supplied thereto. The timer 68 commences time elapse measurement in response to the output "Q" of the RS flip-flop 66 and sends back a reset signal to the RS flip-flop when a predetermined time has elapsed.

Various Operation Modes of First Electronic Wristwatch

Various operation modes of the first electronic wristwatch with the above-described arrangements will now be described.

(I) Upper Case 1 is Closed On Lower Case 2

In this operation mode, since no light is illuminated to the optical sensor 11 provided on the lower surface of the upper case 1, the output from the optical sensor 11 becomes a L (low) level and the power supply controlling circuit 71 interrupts the supply of power from the power supply battery 22 to the second circuit unit 60 employed in the upper case 1 (see FIG. 4). In other words, the liquid crystal display panel 16 which is not utilized during this operation mode is not driven, whereby total power consumption of the power supply battery 22 can be reduced or suppressed by the power consumption of the liquid crystal display panel 16.

It should be noted that since the supply of power from the power supply battery 22 is performed to the first circuit unit 50 employed in the upper case 1 not via the power supply controlling circuit 71 (see FIG. 4), no light is transmitted to the optical sensor 11, but the hour/minute hands 56 of the hand display unit 4 provided on the upper surface of the upper case 1 indicate present time.

Also, in this case, since the key sheet 24 employed at the upper surface of the lower case 2 is not operated, namely no input signal is supplied from the input unit 42 shown in FIG. 4, it is not required to supply power to the first circuit unit 40 of the lower case 2 from the power supply battery 25. As a result, the power supply switch "SW" is turned OFF so that power consumption of the power supply battery 25 can be saved or reduced.

(II) Upper Case 1 Is Opened Over Lower Case 2

In this operation mode, assuming now that the power supply switch "SW" is brought into the ON state, the light emitting diode 29*i* of the photocoupler unit 33 was already energized to irradiate light therefrom. When the upper case 1 is opened at a certain opening angle smaller than the preselected opening angle, the signal output from the optical sensor 11 becomes the H-level and the power from the power supply battery 22 is supplied to the second circuit unit 60 of the upper case 1 under control of the power supply controlling circuit 71, so that the second circuit unit 60 of the upper case 1 is brought into the operable condition. Then, when the upper case 1 is further opened and the opening angle defined between the upper case 1 and lower case 2 becomes the preselected opening angle, as previously stated, the light emitting diode 29*i* which has so far emitted the light is positioned opposite to the photosensor 30*i*, and then the photosensor 30*i* detects the light come from the light emitting diode 29*i*. The detected output is amplified by the amplifier 61*i* and the amplified output is supplied to the rising-edge detecting circuit 65. At this time, the rising-edge detecting circuit 65 detects the rising edge of the output detected from the amplifier 61, supplies the one-shot pulse signal to the RS flip-flop 66, and thereafter the output "Q" from this RS flip-flop is furnished to the sound device 67 and timer 68. Thus, the sound device 67 produces sound until a time period measured by the timer 68 reaches a predetermined time. At this time, a user can recognize by hearing the sound that the respective light emitting diodes are positioned opposite to the photosensors employed in the photocoupler unit 33, so that he stops to open the upper case 1. In this case, each of the light emitting diodes is positioned opposite to the corresponding photosensors employed in the photocoupler unit 33, and then the light signals derived from the light emitting diodes are detectable by the photosensors.

Thus, under the above-described condition, when, for instance, the data are inputted by manipulating the sheet switch of the key sheet 24 provided in the input unit 42, the display drive signal and the like from the amplifier 45 are supplied via the photocoupler unit 33 to the second circuit unit 60 of the upper case 1 in order to display the data on the liquid crystal display panel 16. Upon receipt of these signals, the common electrode drive signal is supplied from the drive signal generating circuit 62 for common electrodes to the liquid crystal display panel 16 and also the segment electrode drive signal is supplied from the drive signal generating circuit 63 for segment electrodes to the liquid crystal display panel 16, so that the above-described data are displayed on the liquid crystal display panel 16.

Modification Of First Electronic Wristwatch

Figure 5:
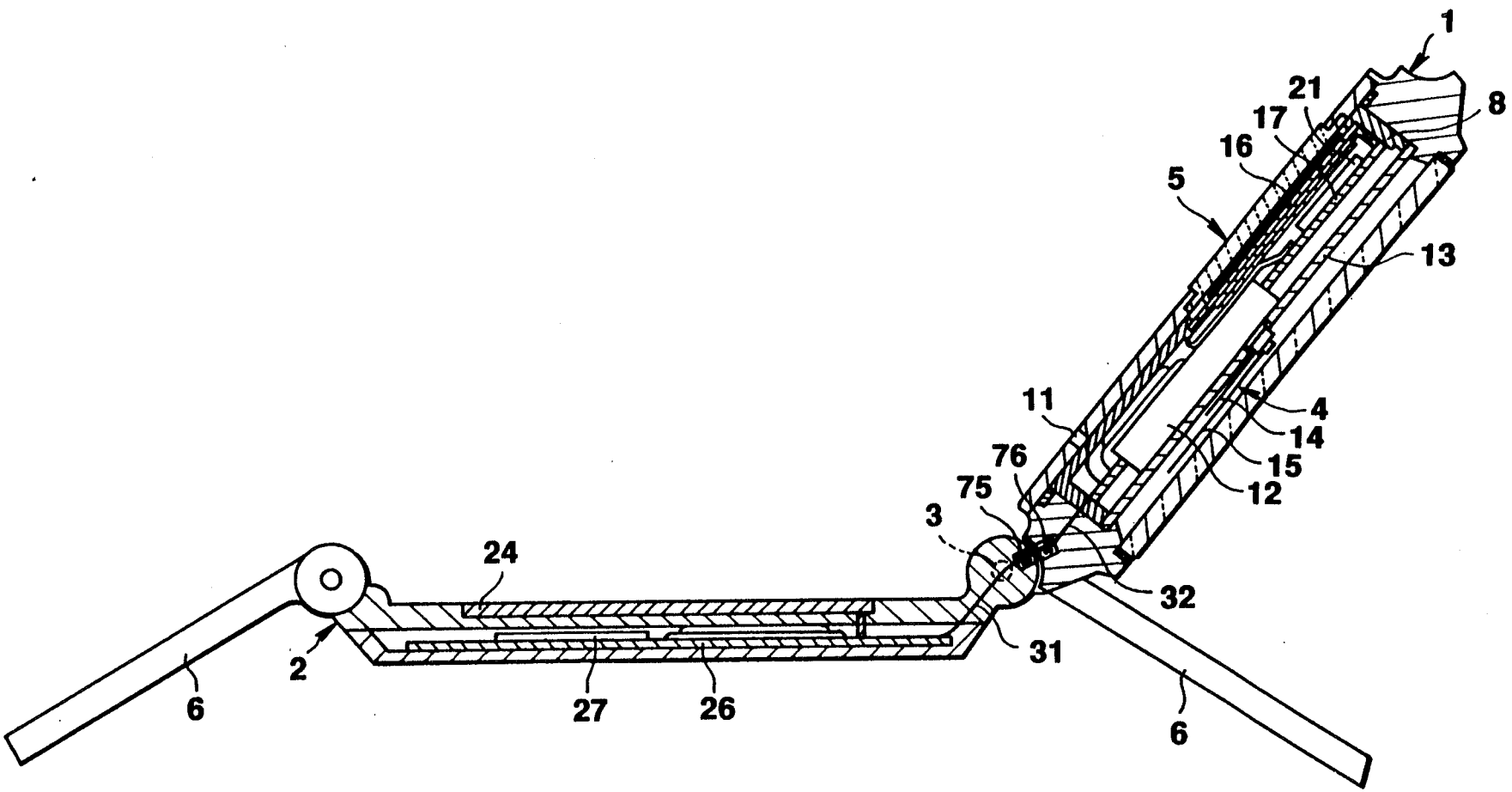
FIG. 5 is a sectional view of another electronic wristwatch according to a modification of the first preferred embodiment.
Figure 6:
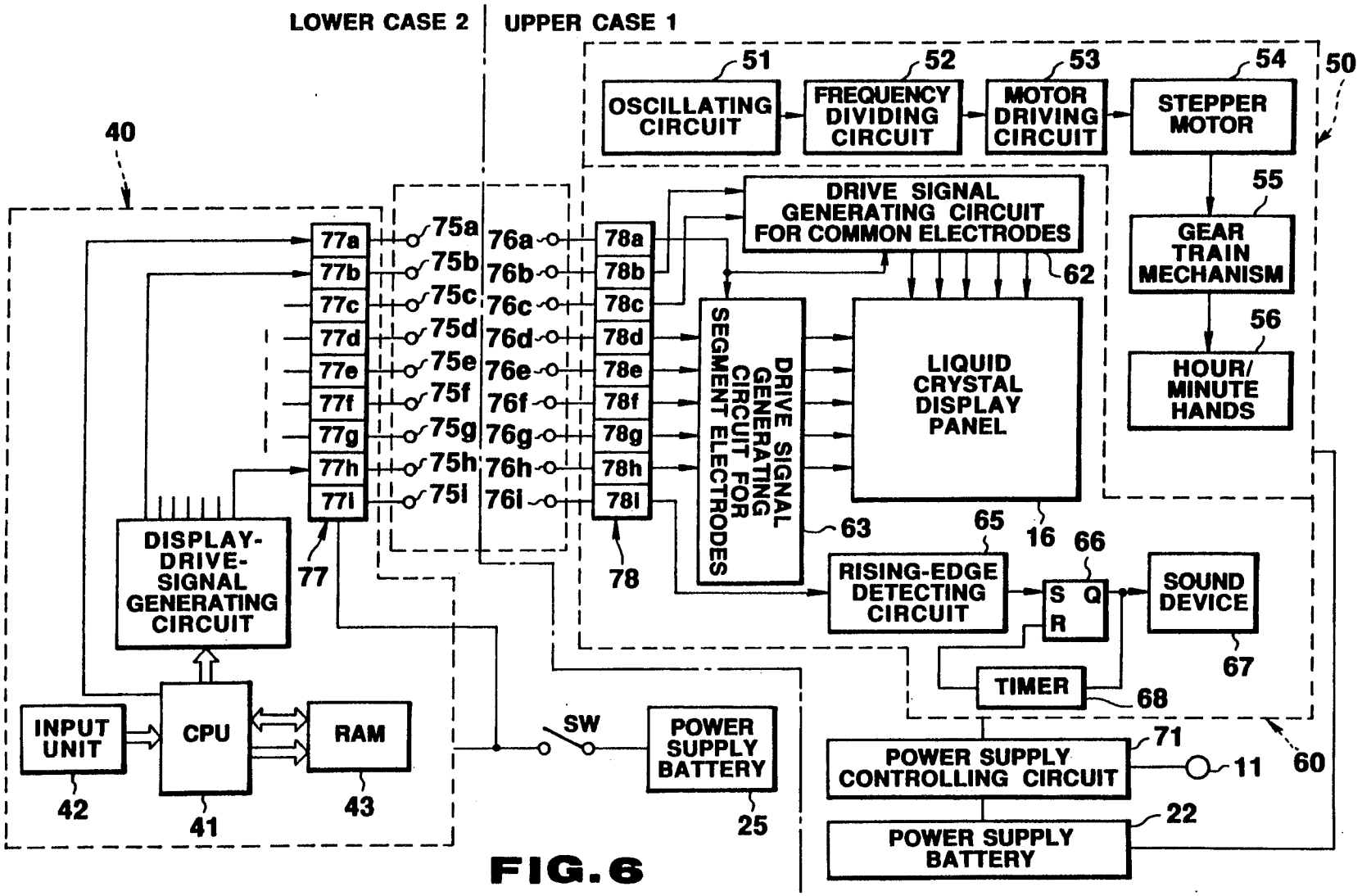
FIG. 6 is a schematic block diagram of a circuit arrangement of the electronic wristwatch shown in FIG. 5.

FIG. 5 is a sectional view of a modification of the first electronic wristwatch and FIG. 6 is a schematic block diagram for showing a circuit arrangement of this modified electronic wristwatch.

In the electronic wristwatch shown in FIG. 5, it is so constructed that the signal transmission between the upper case 1 and lower case 2 is realized by way of electromagnetic induction effects with employment of a primary coil 75 and a secondary coil 76, instead of the light emitting diode 29 and photosensor 30 as represented in FIG. 4.

Precisely speaking, 9 pieces of primary coils 76*a* to 75*i* are provided with the lower case 2, whereas 9 pieces of secondary coils 76*a* to 76*i* are employed in the upper case 1. When the upper case 1 is opened at a preselected opening angle with respect to the lower case 2, 9 pieces of primary coils 75*a* to 75*i* are positioned opposite to 9 pieces of secondary coils 76*a* to 76*i*. The primary coil 75*a* and the secondary coil 76*a* corresponding to this primary coil 75*a* are utilized so as to transmit the timing signals. 7 pieces of primary coils 75*b* to 75*h* and 7 pieces of secondary coils 76*b* to 76*h* corresponding to these primary coils 75*b* to 75*h* are employed so as to transmit the display drive signal. The remaining primary coil 75*i* and the remaining secondary coil 76*i* corresponding to this primary coil 75*i* are utilized for detecting that the upper case 1 is opened at a preselected opening angle.

A different point between the circuit arrangement of the modified electronic wristwatch shown in FIG. 6 and that of the first electronic wristwatch shown in FIG. 4, is as follows. In the previous circuit arrangement of the first electronic wristwatch, the 0 and 1 (digital) signals are merely amplified and then supplied to the light emitting diodes 29*a* to 29*i* so as to control turning ON/OFF of the light emitting diodes 29*a* to 29*i*, and also the optical signals can be converted into the 0 and 1 signals by only amplifying the output signals from the photosensors 30*a* to 30*i*. To the contrary, according to the modified electronic wristwatch, since the primary coil 75 and the secondary coil 76 are employed instead of the above-described photocoupler units, it is necessary to newly employ a primary coil controlling device 77 for controlling whether or not a pulse current is supplied to the primary coil 75 in response to the digital (0,1) signals, and also a secondary coil controlling device 78 for detecting whether or not an induction current is produced from the secondary coil 76, whereby the digital (0,1) signals are generated. The primary coil controlling device 77 owns 9 pieces of primary coil controlling circuits 77*a* to 77*i* corresponding to the respective primary coils 75*a* to 75*i*, whereas the secondary coil controlling device 78 has 9 pieces of secondary coil controlling circuits 78*a* to 78*i* corresponding to the respective primary coils 76*a* to 76*i*.

In the modified electronic wristwatch shown in FIG. 6, when the power supply switch "SW" is turned ON, a signal is supplied to the primary coil controlling circuit 77*i* and therefore a pulse current is continuously supplied to the primary coil 75*i* every predetermined time. When the upper case 1 is opened to a preselected opening angle and thus the primary coil 75*i* is positioned close to the secondary coil 76*i*, an induction voltage is produced at the secondary coil 76*i*. Upon detection of the voltage induced at the secondary coil 76*i*, the secondary coil controlling circuit 78*i* generates a 1-level signal which will be then supplied to the rising-edge detecting circuit 65. When the rising edge of this 1-level signal is detected by the rising-edge detecting circuit 65, the RS flip-flop 66 is set and a specific sound is produced from the sound device 57, which announces that the upper case 1 is opened to a preselected opening angle and then the primary coil 75 is positioned opposite to the secondary coil 76.

After the power supply switch "SW" is turned ON, a timing signal is supplied from CPU 41 to the primary coil controlling circuit 77*a* which will then output the pulse current to the primary coil 77*c* in synchronism with the timing signal. As a result, an induction voltage is proceded in the secondary coil 76*a* in synchronism with the timing signal and another timing signal is generated from the secondary coil controlling circuit 78*a* in synchronism with the induction voltage. This timing signal from the secondary coil controlling circuit 78*a* is supplied to the drive signal generating circuit 62 for common electrodes and the drive signal generating circuit 63 for segment electrodes.

Then, when data are inputted by operating the switch of the input unit 42, for instance, the display drive signal is supplied to the primary coil controlling circuits 77*b* to 77*h* in synchronism with the timing signal, and then the primary coils 75*b* to 75*h* are selectively driven in accordance with the display drive signal. As a result, another induction voltage is also induced from the secondary coils 76*b* to 76*h*, and thereafter a signal corresponding to such a fact whether or not the induction voltage is produced from the secondary coil controlling circuits 78*b* to 78*h* is supplied to the drive signal generating circuit 62 for common electrodes and the drive signal generating circuit 63 for segment electrodes in synchronism with the timing signal so that the inputted data is displayed.

As previously described in the first preferred embodiment of the present invention, either the electro-optical converting means or the electro-magnetic converting means is provided with the lower case 2, and either the optical-electric converting means or the magnetic-electric converting means is employed in the upper case 1 so as to transmit the signals to the electronic circuit employed in the upper case 1. It should be noted that either the electro-optical converting means or the electro-magnetic converting means is equipped with the upper case 1, and also either optical-electric converting means or the magnetic-electric converting means is employed in the lower case 2, in order that the signals may be transmitted from the electronic circuit employed in the upper case 1 to the electronic circuit employed in the lower case 2.

In accordance with the first preferred embodiment, since the electronic apparatus is so arranged that the data transmission between the electronic circuits employed in the upper case and lower case is performed by way of the electro-optical converting means and optical-electronic converting means without employing the flexible connectors, both the reliability and durability which are deteriorated by employing such flexible connectors can be improved.

(2) Second Electronic Wristwatch

Referring now to FIGS. 7 to 11, an electronic wristwatch according to a second preferred embodiment of the present invention will be described. It should be noted that the same reference numerals shown in the first electronic wristwatch of FIGS. 1 to 6 will be employed as those for denoting the same circuit elements shown in the following FIGS. 7 to 11, and a further explanation thereof is omitted.

A major difference point between the first preferred embodiment and the second preferred embodiment is as follows. That is, the power supply batteries 22 and 25 have been stored in the upper case 1 and lower case 2 so as to drive the electronic components employed in the respective upper and lower cases in the first electronic wristwatch. To the contrary, only a power supply battery is stored in the lower case 2 and power can be supplied from this power supply battery to electronic components employed in the upper case 1 without employing any lead wire.

(a) Construction Of Second Electronic Wristwatch

Figure 7:
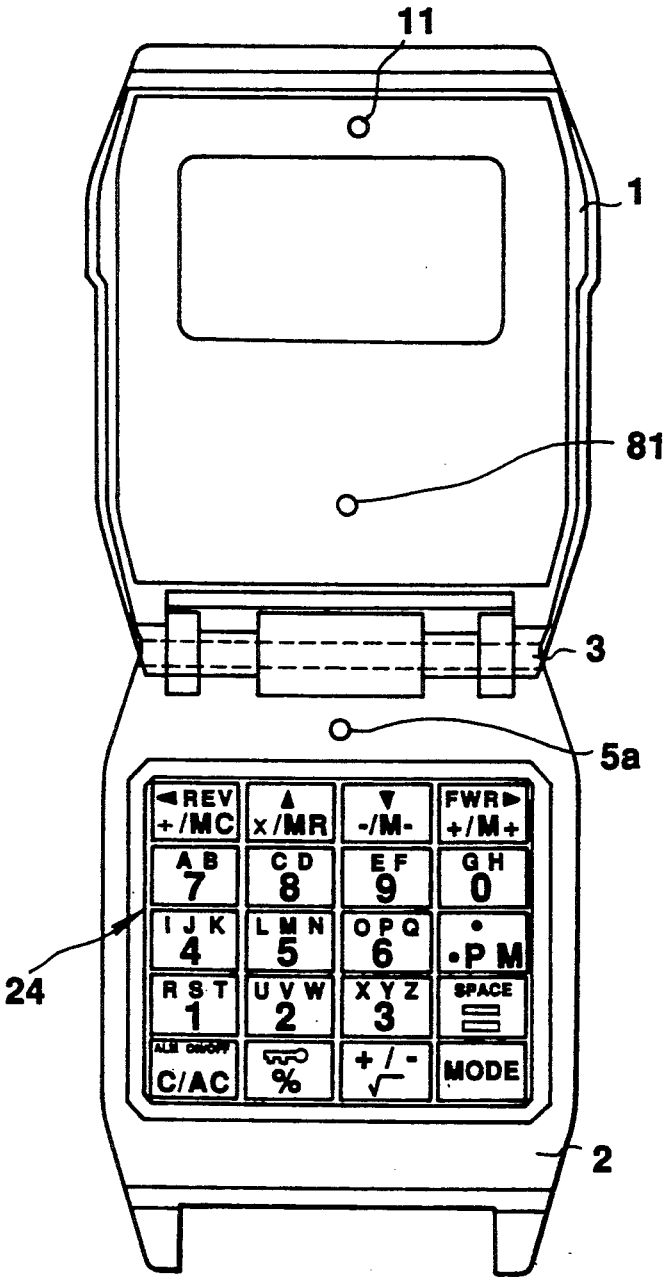
FIG. 7 is a plan view of an electronic wristwatch, according to a second preferred embodiment of the present invention, an upper case of which is opened.

In FIG. 7, there is shown the electronic wristwatch, according to the second preferred embodiment, with the opened upper case 1. At a lower surface of the upper case 1, an optical sensor 11 for detecting the opening/-closing operations of the upper case 1 is mounted, and also a light emitting diode 81 is mounted. At an upper surface of the lower case 2, an optical sensor 82 is provided in such a manner that when the upper case 1 is closed on this lower case 2, this optical sensor 82 is positioned opposite to the light emitting diode 81.

Figure 8:
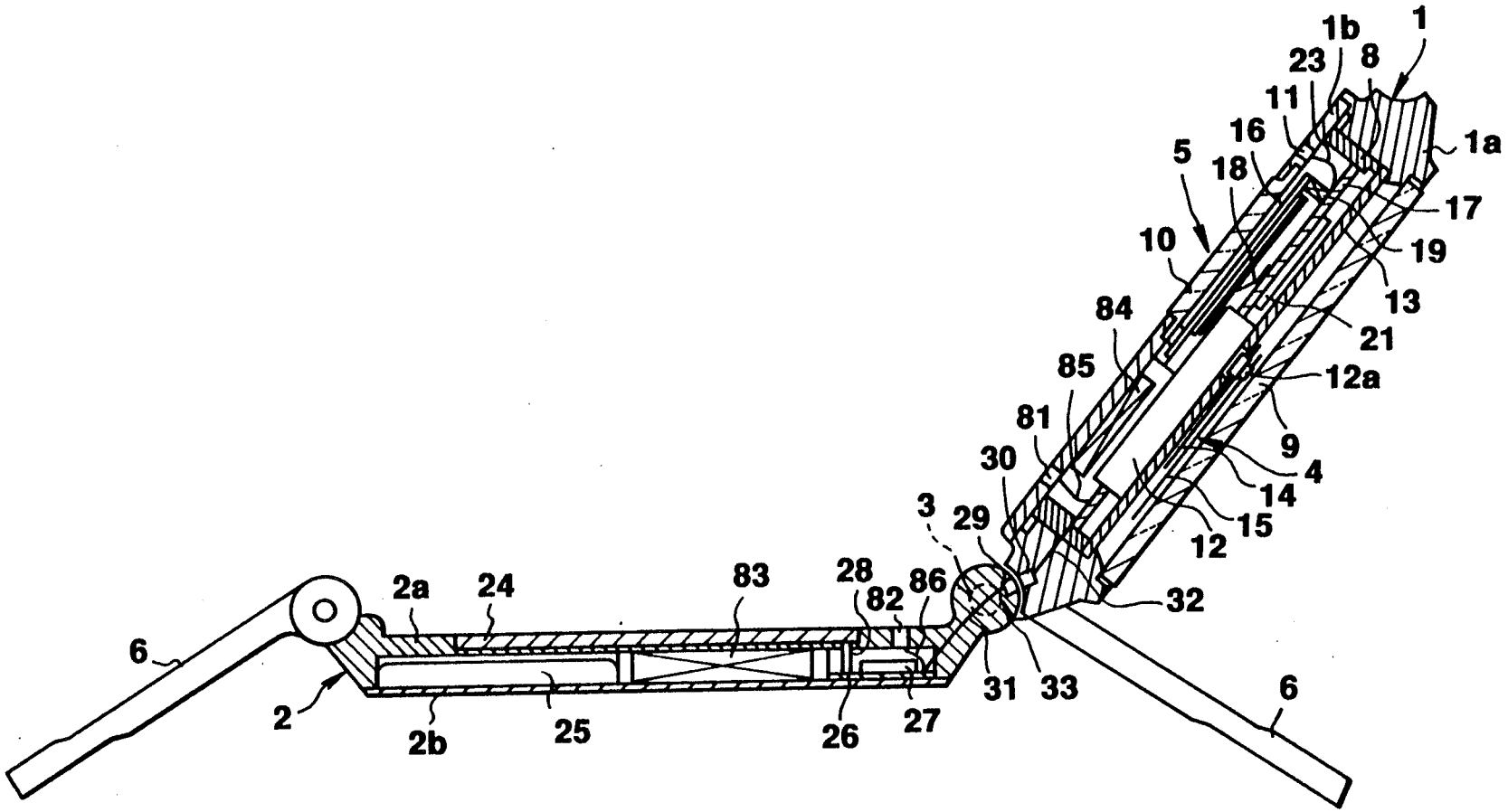
FIG. 8 is a sectional view of the electronic wristwatch shown in FIG. 7, the upper case of which is opened.

FIG. 8 is a sectional view of the second electronic wristwatch, the upper case 1 of which is opened. As shown in FIG. 8, a battery 25 is arranged under the key sheet 24 of the lower case 2 and a primary coil 83 is positioned, whereas a secondary coil 84 is stored within the upper case 1. Both the optical sensor 11 and light emitting diode 81 arranged at the lower surface of the upper case 1 are electrically connected via lead wires 23 and 85 to the circuit board 17. The optical sensor 82 arranged at the upper surface of the lower case 2 is electrically connected via a lead wire 86 to the circuit board 26.

Circuit Arrangement of Second Electronic Wristwatch

Figure 9:
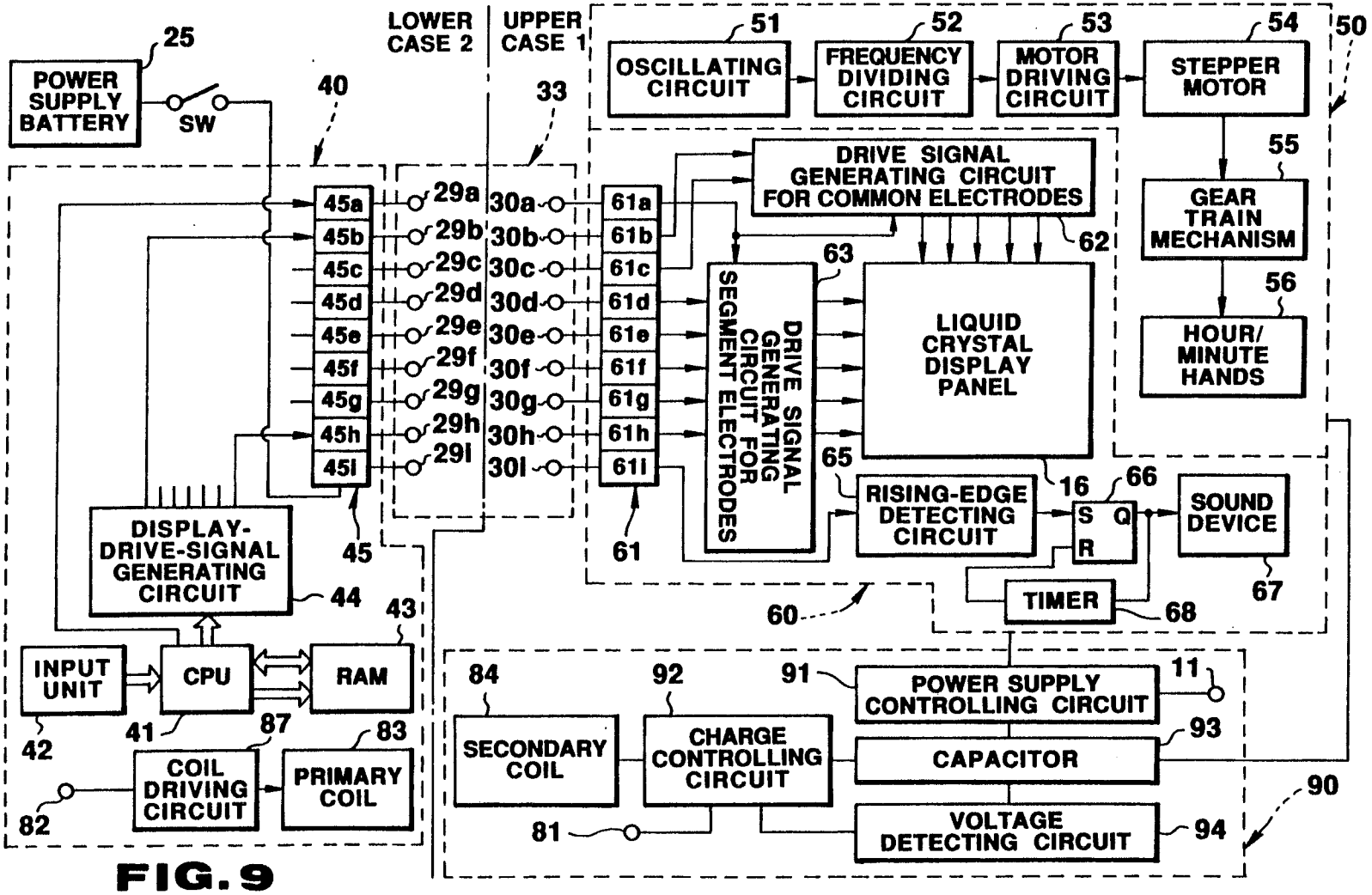
FIG. 9 is a schematic block diagram for showing a circuit arrangement of the electronic wristwatch shown in FIG. 7.

FIG. 9 represents a circuit arrangement of the second electronic wristwatch. As apparent from FIG. 9, there are the following different arrangements as compared with FIG. 4. That is, no power supply battery is employed in the upper case 1. Instead of this battery, a power supply unit 90 is employed. Furthermore, the primary coil 83, a coil driving circuit 87 and the optical sensor 82 are employed in the lower case 2.

The optical sensor 82 employed in the lower case 2 detects either externally supplied light, or light from the light emitting diode 81 to supply a detection signal to the coil driving circuit 87. When the coil driving circuit 87 does not send any detection signal from the optical sensor 82, namely when the upper case 1 is closed and the light emitting diode 81 does not emit any light, an alternating current may flow through the primary coil 83 whereby an alternating magnetic flux is produced therefrom.

In the power supply unit 90 shown in FIG. 9, while the upper case 1 is closed on the lower case 2 and the alternating magnetic flux is generated from the primary coil 83, the secondary coil 84 produces an induction electromotive force therefrom by intersecting with the alternating magnetic flux. A charge controlling circuit 92 charges a capacitor 93 by converting the induction electromotive force obtained from the secondary coil 84 into DC power, and also turns ON the light emitting diode 81 upon receipt of such a signal that the charging state of the capacitor 93 is sufficient, derived from a voltage detecting circuit 94. As previously described, the capacitor 93 is charged under control of the charge controlling circuit 92, and also continuously supplies power to both a first circuit unit 50 of the upper case 1 and a second circuit unit 60 of this upper case 1 under control of the power supply controlling circuit 91. The voltage detecting circuit 93 detects the voltage across the capacitor 93 and sends to the charge controlling circuit 92 such a signal indicating that this detection voltage is higher than a predetermined value and the capacitor is sufficiently charged. The power supply controlling circuit 91 controls the supply of voltage across the capacitor 93 to the second circuit 60 employed in the upper case 1 when the output from the optical sensor 11 becomes a H-level, or the upper case 1 is opened.

Various Operation Modes Of Second Electronic Wristwatch

Various operation modes of the second electronic wristwatch with the above-described arrangements will now be described. It should be noted that the power supply switch "SW" is turned ON and power is continuously supplied from the power supply battery 25 to the circuit unit 40 of the lower case 2.

(III) Upper Case 1 Is Closed On Lower Case 2

In this operation mode, since no light is illuminated onto the optical sensor 11 employed on the lower surface of the upper case 1, the output from the optical sensor 11 becomes a L-level and the power supply controlling circuit 91 stops to supply power from the capacitor 93 to the second circuit unit 60 of the upper case 1. In other words, in this operation mode, the liquid crystal display panel 16 which is no chance to be used in this case is not driven, so that power consumption of the energy stored in the capacitor 93 can be saved or reduced by the power consumed by this liquid crystal display panel 16.

It should be noted that since the supply of power of the capacitor 93 is performed without control of the power supply controlling circuit 91 to the first circuit unit 50 of the upper case 1, this power supply operation is continued even when no light is illuminated to the optical sensor 11, so that the hour/minute hands 56 of the hand display unit 4 employed on an upper surface of the upper case 1 indicate present time.

In this case, if the capacitor 93 is fully charged, the voltage detecting circuit 94 for continuously detecting the voltage across this capacitor 93 delivers a full-charge signal indicating that the capacitor is being fully charged to the charge controlling circuit 92, and then this charge controlling circuit 92 turns ON the light emitting diode 81 in response to this full-charge signal. In this case, since the light emitting diode 81 mounted on the lower surface of the upper case 1 is positioned opposite to the optical sensor 82 mounted on the upper surface of the lower case 2 when the upper case 1 is closed on the lower case 2, the light emitted from the light emitting diode 81 is irradiated onto the light sensor 82 which will then supply an H-level signal to the coil driving circuit 87. Upon receipt of this H-level signal, the coil driving circuit 87 stops to cause an alternating current to be flow through the primary coil 83.

On the other hand, when the full-charge condition of the capacitor 93 is not maintained, the above-described full-charge signal is no longer supplied from the voltage detecting circuit 94 to the charge controlling circuit 92 and then the charge controlling circuit 92 stops to energize the light emitting diode 81. As a result, no light is irradiated to the photosensor 82 employed at the lower case 2 (in this case, since the upper case 1 is closed on the lower case 2, no externally incident light is irradiated onto the photosensor 82), a level of a signal from the optical sensor 82 to the coil driving circuit 87 becomes an L-level. Upon receipt of the L-level signal, the coil driving circuit 87 converts the DC current derived from the power supply battery 25 into the alternating current, and thereafter this alternating current flows through the primary coil 83, whereby an alternating magnetic flux is produced. Then, the secondary coil 84 intersects with the above-described alternating magnetic flux so that an induction electromotive force is produced therefrom, which will be then applied to the charge controlling circuit 92. Thereafter, the charge controlling circuit 92 converts the induction electromotive force into the DC power so as to charge the capacitor 93.

As previously described, when the charging state of the capacitor 93 is recovered and becomes a full-charging condition, a full-charging signal is similarly supplied from the voltage detecting circuit 94 to the charge controlling circuit 92, with the result that the light emitting diode 81 is turned ON under control of the charge controlling circuit 92, the light emitted from the light emitting diode 81 is incident upon the optical sensor 82 which will then supply an H-level signal, and the coil driving circuit 87 interrupts to cause the alternating current to be flown into the primary coil 83 in response to this H-level signal.

(IV) Upper Case 1 Is Opened On Lower Case 2

In this operation mode, since light is externally incident upon the optical sensor 82 employed on the upper surface of the lower case 2, neither an alternating magnetic flux is produced from the primary coil 83 irrelevant to emissions from the light emitting diode 81, nor the capacitor 93 is charged.

Also, in this case, the light emitting diode **29*i* of the photocoupler unit 33 already emits the light therefrom; the output signal from the optical sensor 11 similarly becomes an H-level when the upper case 1 is opened up to a certain opening angle; the power supply controlling circuit 91 supplies power or voltage from the capacitor 93 to the second circuit 60 of the upper case 1; and the second circuit unit 60 of the upper case 1 is brought into an active, or operable state. Thereafter, when the upper case 1 is further opened and then an angle defined between the upper case 1 and the lower case 2 reaches a predetermined opening angle, as previously described, the light emitting diode 29*i* which has already emitted the light is positioned opposite to the photosensor 30*i*; this photosensor 30*i* detects the light emitted from the light emitting diode 29*i*, and the detected output from the photosensor 30*i* is amplified by the amplifier 61*i* and the resultant output is supplied to the rising-edge detecting circuit 65. At this time, the rising-edge detecting circuit 65 detects the rising edge of the detection output from the amplifier 61 and supplies one-shot pulse signal to the RS flip-flop 66. Then, the output "Q" of the RS flip-flop 66 is supplied to both the sound device 67 and timer 68. The sound device 67 continues to produce sound until the timer 68 counts up a predetermined time period. At this time, a user can recognize that the respective light emitting diodes are positioned opposite to the corresponding photosensors employed in the photocoupler unit 33 by hearing this sound information and therefore stops to open the upper case 1. Under such a circumstance, since the respective light emitting diodes are positioned opposite to the corresponding photodiodes employed in the photocoupler unit 33**, the optical signals derived from the light emitting diodes may be detected by the photosensors.

Subsequently, when, for instance, the various data are inputted by operating the sheet switch of the key sheet 24 employed in the input unit 42, the display drive signal and the like are supplied from the amplifier 45 via the photocoupler unit 33 to the second circuit unit 60 of the upper case 1 in order to display these data on the liquid crystal display panel 16. That is, in response to the display drive signals, the drive signal generating circuit 62 for common electrodes supplies the common electrode drive signal to the liquid crystal display panel 16 and the drive signal generating circuit 63 for segment electrodes supplies the segment electrode drive signal to this liquid crystal display panel 16, so that the above-described data are displayed thereon.

Modifications Of Second Electronic Wristwatch

Figure 10:
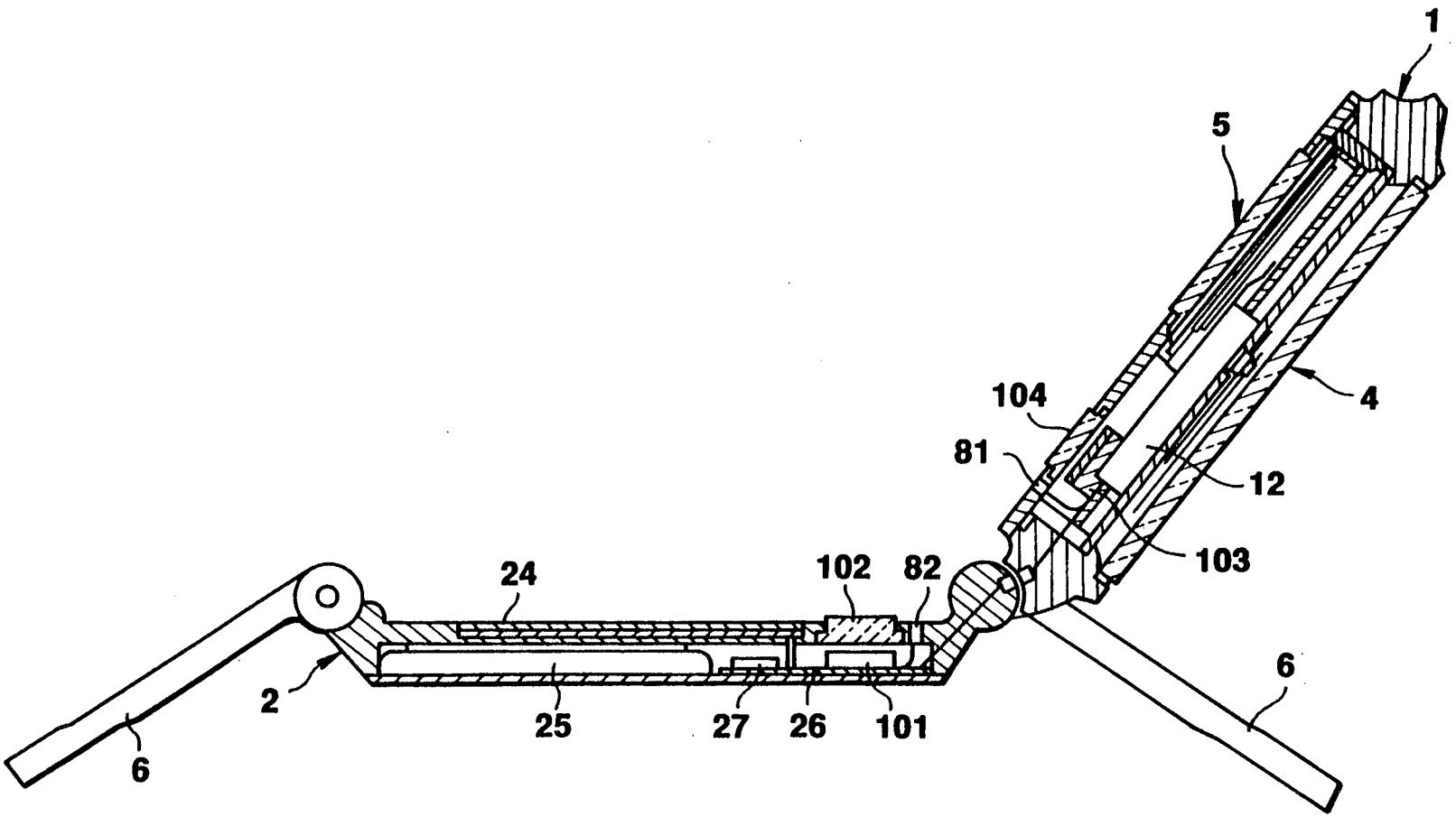
FIG. 10 is a sectional view of another electronic wristwatch according to a modification of the second preferred embodiment; and, FIG. 11 is a sectional view of a further electronic wristwatch according to a further modification of the second preferred embodiment.

FIG. 10 is a sectional view for representing a first modification of the second electronic wristwatch according to the present invention. In the first modified second electronic wristwatch shown in FIG. 10, a light emitting member 101 is equipped with the lower case 2 instead of the above-described primary coil 83, and also a glass 102 is provided on an upper surface of the lower case 2, whereas a solar cell 103 is provided within the upper case 1 instead of the above-explained secondary coil 84, and also a glass 104 is employed on a lower surface of the upper case 1. It should be noted that the remaining circuit arrangements of this modified electronic wristwatch are identical to those of the second electronic wristwatch shown in FIG. 7. Then, when a total charge amount of the capacitor is not sufficient with respect to the expected charge amount under such a condition that the upper case 1 is closed on the lower case 2, the light emission of the light emitting diode 81 is stopped, and the signal derived from the optical sensor 82 becomes a L-level, the light emitting member 101 is driven or energized. The light emitted from the light emitting member 101 is incident upon the solar cell 103 via the glasses 102 and 104. The solar cell 103 converts the incident optical energy to electric energy which will be then charged into the capacitor.

Figure 11:
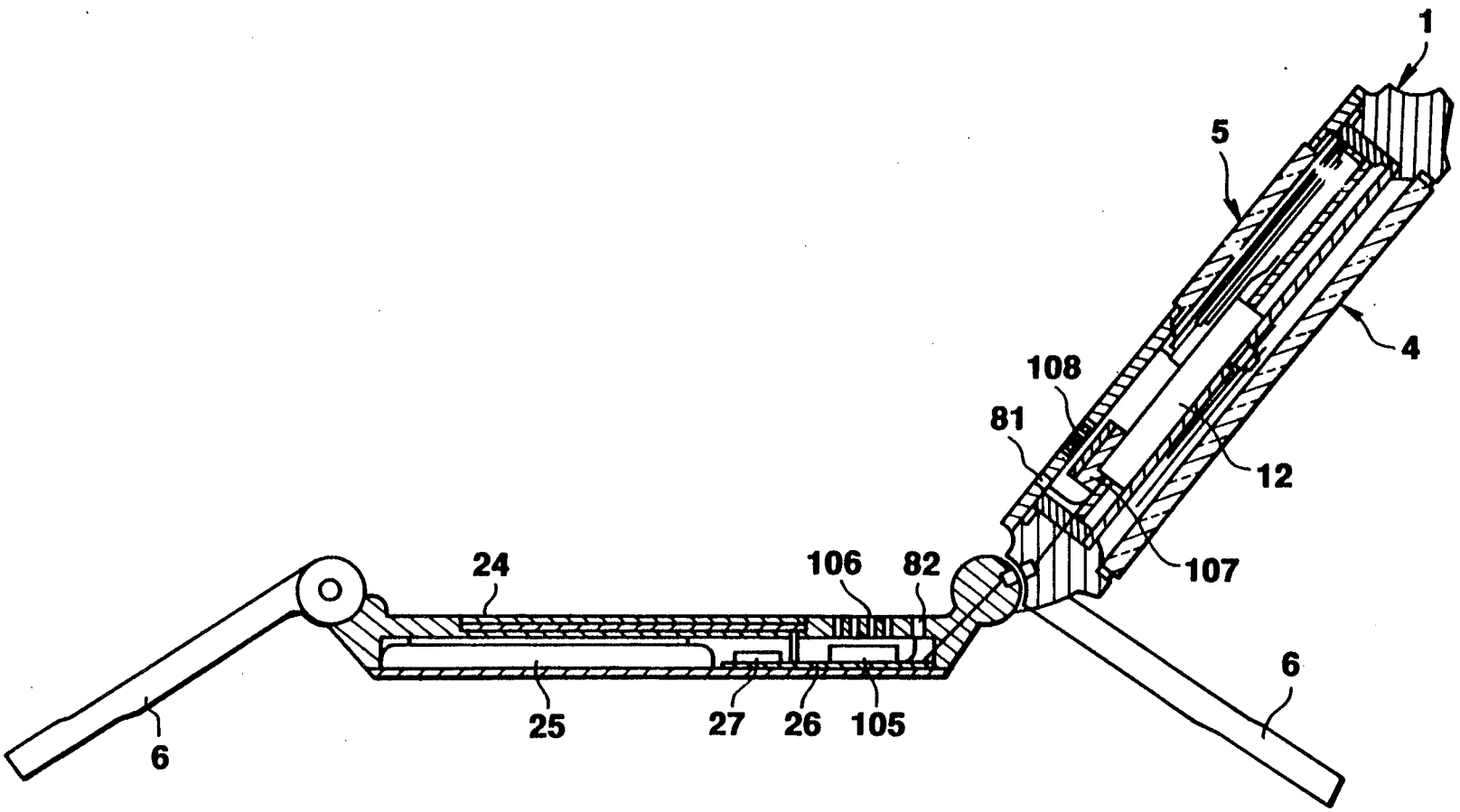

FIG. 11 is a sectional view of a second modification of the second electronic wristwatch according to the present invention. In the second modified electronic wristwatch shown in FIG. 11, a sound generating member 105 is equipped with the lower case 2 instead of the primary coil 83 and a large quantity of holes 106 are formed on the upper surface of the lower case 2, whereas a microphone 107 is employed within the upper case 1 instead of the secondary coil 84 and also a large number of holes 108 are similarly formed on a lower surface of the upper case 1. The remaining circuit arrangements of the second modified electronic wristwatch are identical to those of the second electronic wristwatch shown in FIG. 7. Then, when a total charge amount of the capacitor is not sufficiently, as compared with the expected charge amount, under such a state that the upper case 1 is closed on the lower case 2, the light emitted from the light emitting diode 81 is stopped, and also the signal level of the optical sensor 82 becomes a L-level, then the sound generating member 105 is driven. The sound generated from the sound generating member 105 is propagated via the holes 106 and 108 to the microphone 107. The microphone 107 converts acoustic energy into electric energy, by which the capacity is charged.

It should be noted that although the power supply battery 25 is stored within the lower case 2 and power of this power supply battery 25 is supplied to the electronic components employed in the upper case 1 by employing either the electromagnetic converting apparatus, electro-optical converting apparatus, or electro-acoustic converting apparatus in the above-described second preferred embodiment, this power supply battery may be alternatively stored with the upper case 1 so as to apply the power supply voltage thereof to the electronic components employed in the lower case 2.

As previously described in detail, in accordance with the second preferred embodiment of the present invention, the power supply operations by the battery stored in the first case to the electronic circuit employed in the second case are carried out by way of the electromagnetic induction effects by the coils employed in the first and second cases, the electro-optical converting element provided with the first case and the optical-electro converting element provided within the second case, for receiving the light emitted from the electro-optical converting element, or the electric-acoustic converting device employed in the first case and the acoustic-electric converting element provided within the second case, for receiving the sound from the electric-acoustic converting device. As a consequence, no lead wire is longer required so as to supply the power from the power supply battery stored in the first case into the electronic circuit employed within the second case. Furthermore, various restrictions such as disconnection of the lead wire, complex water-resist construction, and design for the water-resist construction can be mitigated.

What is claimed is:

1. An electronic apparatus, comprising:

a first case having a first electronic circuit therein;

a second case having a second electronic circuit, which is movably mounted on the first case and which is movable relative to the first case between opening and closing positions;

portion of the first case positioned opposite to the second case when the second case is opened to a predetermined opening angle, for converting a first electric signal obtained from the first electronic circuit within the first case into an optical signal; and, optical-electronic converting means mounted to a second portion of the second case positioned opposite to the electro-optical converting means when the second case is opened at said predetermined opening angle, for receiving the optical signal produced by the electro-optical converting means to be converted into a second electric signal and for supplying the electric signal to the second electronic circuit employed within the second case.

2. An electronic apparatus as claimed in claim 1, wherein said second case includes:

opening-angle detecting means for detecting that said electric-optical converting means is positioned opposite to said optical-electric converting means; and, announcing means for announcing such a detection that said second case is opened at said predetermined opening angle, by said opening-angle detecting means.

3. An electronic apparatus as claimed in claim 2, wherein said opening-angle detecting means includes:

position detecting electro-optical converting means provided at a third portion of said first case positioned opposite to said second case when said second case is opened at a predetermined angle, for converting an electric signal into an optical signal so as to detect a position; and, position detecting optical-electro converting means provided on a fourth portion of said second case positioned opposite to said electro-optical converting means when said second case is opened at a predetermined opening angle, for converting an optical signal into an electric signal, thereby outputting a detection signal when said second case is opened at said predetermined opening angle and the optical signal generated from said electro-optical converting means is received.

4. An electronic apparatus as claimed in claim 1, wherein said second case includes:

opening/closing operation detecting means for detecting opening/closing operations of said second case; and, power supply controlling means for controlling a supply of power to a second electronic circuit employed in said second case when said opening/closing operation detecting means detects such that said second case is opened.

5. An electronic apparatus as claimed in claim 1, wherein a plurality of keys are provided on an upper surface of said first case and electro-optical display means is provided on a lower surface of said second case.

6. An electronic apparatus as claimed in claim 1, wherein a wristwatch belt is attached to said first case, and time display means is provided on an upper surface of said second case.

7. An electronic apparatus, comprising:

a first case having a first electronic circuit a second case having a second electronic circuit, which is movably mounted on the first case and which is movable relative to the first case between opening and closing positions;

electro-optical converting means provided on a first portion of said second case which is located opposite to said first case when said second case is opened at a predetermined opening angle, for converting an electric signal obtained from said second electronic circuit employed in the second case into an optical signal; and, optical-electric converting means provided at a second portion of said first case which is located opposite to said electro-optical converting means when said second case is opened at said predetermined opening angle, for converting an optical signal generated from said electro-optical converting means into an electric signal so as to supply said electric signal to the first electronic circuit employed in said first case.

8. An electronic apparatus as claimed in claim 7, wherein said second case includes:

opening-angle detecting means for detecting that said electric-optical converting means is positioned opposite to said optical-electric converting means; and, announcing means for announcing such a detection that said second case is opened at said predetermined opening angle, by said opening-angle detecting means.

9. An electronic apparatus as claimed in claim 8, wherein said opening-angle detecting means includes:

position detecting electro-optical converting means provided at a third portion of said second case positioned opposite to said first case when said second case is opened at said predetermined opening angle, for converting an electric signal into an optical signal so as to detect a position; and, position detecting optical-electro converting means provided on a fourth portion of said first case opposite to said electro-optical converting means when said second case is opened at a predetermined opening angle, for converting an optical signal into an electric signal, thereby outputting a detection signal when said second case is opened at said predetermined opening angle and the optical signal generated from said electro-optical converting means is received.

10. An electronic apparatus as claimed in claim 7, wherein said second case includes:

opening/closing operation detecting means for detecting opening/closing operations of said second case; and, power supply controlling means for controlling a supply of power to a second electronic circuit employed in said second case when said opening/closing operation detecting means detects such that said second case is opened.

11. An electronic apparatus as claimed in claim 7, wherein a plurality of keys are provided on an upper surface of said first case and electro-optical display means is provided on a lower surface of said second case.

12. An electronic apparatus as claimed in claim 7, wherein a wristwatch belt is attached to said first case, and time display means is provided on an upper surface of said second case.

13. An electronic apparatus, comprising:

a first case;

a second case which is movable relative to the first case between opening and closing positions;

a battery stored within said first case;

a primary coil stored in said first case and energized by a voltage of said battery;

a secondary coil employed within said second case in such a manner that when said second case is closed, said secondary coil is positioned close to said primary coil;

detecting means for detecting opening/closing operations of said second case;

coil driving means for driving said primary coil when said detecting means detects that said second case is closed;

charge storage means charged by an electromotive voltage generated in said secondary coil when said primary coil is driven by said coil driving means employed in said second case; and an electronic circuit provided within said second case, and driven by electric energy charged in said charge storage means.

14. An electronic apparatus as claimed in claim 13, further comprising:

voltage detecting means for detecting that a voltage of said charge storage means is higher than a predetermined value; and, charge stopping means for stopping drive operation of said primary coil when said voltage detecting means detects that the voltage of said charge storage means becomes higher than said predetermined value.

15. An electronic apparatus as claimed in claim 13, wherein said second case includes:

power supply controlling means for controlling a supply of power to said electronic circuit employed within said second case when said detecting means detects that said second case is detected.

16. An electronic apparatus as claimed in claim 13, further comprising:

electro-optical converting means provided at a first portion of said first case positioned opposite to said second case when said second case is opened at a predetermined opening angle, for converting an electric signal obtained from an electronic circuit of said first case into an optical signal so as to detect a position; and, optical-electro converting means provided on a second portion of said second case positioned opposite to said electro-optical converting means when said second case is opened at said predetermined opening angle, for converting an optical signal into an electric signal to be supplied to the electronic circuit of said second case when said second case is opened at said predetermined opening angle and the optical signal generated from said electro-optical converting means is received.

17. An electronic apparatus as claimed in claim 16, wherein said second case includes:

opening-angle detecting means for detecting that said electric-optical converting means is positioned opposite to said optical-electric converting means; and, announcing means for announcing such a detection that said second case is opened at said predetermined opening angle, by said opening-angle detecting means.

18. An electronic apparatus as claimed in claim 17, wherein said opening-angle detecting means includes:

position detecting electro-optical converting means provided at a third portion of said first case positioned opposite to said second case when said second case is opened at said predetermined opening angle, for converting an electric signal into an optical signal so as to detect a position; and, position detecting optical-electro converting means provided on a fourth portion of said second case positioned opposite to said electro-optical converting means when said second case is opened at said predetermined opening angle, for converting an optical signal into an electric signal, thereby outputting a detection signal when the optical signal generated from said electro-optical converting means is received.

19. An electronic apparatus as claimed in claim 13, wherein a plurality of keys are provided on an upper surface of said first case and electro-optical display means is provided on a lower surface of said second case.

20. An electronic apparatus as claimed in claim 13, wherein a wristwatch belt is attached to said first case, and time display means is provided on an upper surface of said second case.

21. An electronic apparatus, comprising:

a first case;

a second case which is movable relative to the first case between opening and closing positions;

a battery stored within said first case;

a primary coil stored in said first case and energized by a voltage of said battery;

a secondary coil employed within said second case in such a manner that when said second case is closed, said secondary coil is positioned close to said primary coil;

detecting means for detecting opening/closing operations of said second case;

coil driving means for driving said primary coil when said detecting means detects that said second case is closed;

charge storage means charged by an electromotive voltage generated in said secondary coil when said primary coil is driven by said coil driving means employed in said first case; and an electronic circuit provided within said first case, and driven by electric energy charged in said charge storage means.

22. An electronic apparatus as claimed in claim 21, further comprising:

voltage detecting means for detecting that a voltage of said charge storage means is higher than a predetermined value; and, charge stopping means for stopping drive operation of said primary coil when said voltage detecting means detects that the voltage of said charge storage means becomes higher than said predetermined value.

23. An electronic apparatus as claimed in claim 21, wherein said second case includes:

power supply controlling means for controlling a supply of power to said second electronic circuit employed within said second case when said detecting means detects that said second case is detected.

24. An electronic apparatus as claimed in claim 21, further comprising:

electro-optical converting means provided at a first portion of said second case positioned opposite to said first case when said second case is opened at a predetermined opening angle, for converting an electric signal obtained from an electronic circuit of said second case into an optical signal so as to detect a position; and, optical-electro converting means provided on a second portion of said first case positioned opposite to said electro-optical converting means when said second case is opened at said predetermined opening angle, for converting an optical signal into an electric signal to be supplied to the electronic circuit of said first case when said second case is opened at said predetermined opening angle and the optical signal generated from said electro-optical converting means is received.

25. An electronic apparatus as claimed in claim 24, wherein said second case includes:

opening-angle detecting means for detecting that said electric-optical converting means is positioned opposite to said optical-electric converting means; and, announcing means for announcing such a detection that said second case is opened at said predetermined opening angle, by said opening-angle detecting means.

26. An electronic apparatus as claimed in claim 25, wherein said opening-angle detecting means includes:

position detecting electro-optical converting means provided at a third portion of said second case positioned opposite to said first case when said second case is opened at said predetermined opening angle, for converting an electric signal into an optical signal so as to detect a position; and, position detecting optical-electro converting means provided on a fourth portion of said first case positioned opposite to said electro-optical converting means when said second case is opened at said predetermined opening angle, for converting an optical signal into an electric signal, thereby outputting a detection signal when the optical signal generated from said electro-optical converting means is received.

27. An electronic apparatus as claimed in claim 21, wherein a plurality of keys are provided on an upper surface of said first case and electro-optical display means is provided on a lower surface of said second case.

28. An electronic apparatus as claimed in claim 21, wherein a wristwatch belt is attached to said first case, and time display means is provided on an upper surface of said second case.

* * * * *